US007323652B2

(12) United States Patent
Yoshida et al.

(10) Patent No.: US 7,323,652 B2
(45) Date of Patent: Jan. 29, 2008

(54) GAS INSULATED SWITCHGEAR

(75) Inventors: Daisuke Yoshida, Tokyo (JP); Haruhiko Kohyama, Tokyo (JP); Yuji Yoshitomo, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 0 days.

(21) Appl. No.: 11/414,343

(22) Filed: May 1, 2006

(65) Prior Publication Data

US 2006/0243091 A1 Nov. 2, 2006

(30) Foreign Application Priority Data

May 2, 2005 (JP) ..... 2005-133791

(51) Int. Cl.
*H01H 33/02* (2006.01)

(52) U.S. Cl. ..... 218/78; 218/154; 218/155

(58) Field of Classification Search ..... 218/7, 218/14, 78, 84, 120, 134, 139, 140, 153–155
See application file for complete search history.

(56) References Cited

U.S. PATENT DOCUMENTS 4,442,329 A * 4/1984 Gray et al. ..... 218/71
4,996,397 A * 2/1991 Kuhn et al. ..... 218/120
5,128,502 A * 7/1992 Hux ..... 218/153
5,735,611 A * 4/1998 Godesa ..... 384/296
6,995,330 B2 * 2/2006 Gimeno ..... 218/79
7,015,410 B2 * 3/2006 Einschenk et al. ..... 218/140

FOREIGN PATENT DOCUMENTS

JP 55-85741 6/1980
JP 4-66026 6/1992

* cited by examiner

*Primary Examiner*—Elvin Enad
*Assistant Examiner*—M. Fishman
(74) *Attorney, Agent, or Firm*—Buchanan Ingersoll Rooney PC

(57) ABSTRACT

The gas insulated switchgear includes a rotary shaft which penetrates a pressure vessel is connected with a moving part which is housed in the pressure vessel by way of a lever, and is connected to the moving part, and brackets which support the rotary shaft and are mounted on a mounting portion which is formed on the pressure vessel. The brackets are fixed to the mounting portion formed on the pressure vessel using a plurality of fixing bolts which are arranged in a spaced-apart manner on an eccentric circle having the center at a point x2 offset from the center of rotation x1 of a rotary shaft and hence, the brackets can be fixed to the mounting portion formed on the pressure vessel at a predetermined angular position which uses the point x2 offset from the center of rotation x1 of the rotary shaft as the center of rotation.

3 Claims, 2 Drawing Sheets

GAS INSULATED SWITCHGEAR

BACKGROUND OF THE INVENTION

1. Field of the Invention

The present invention relates to a gas insulated switchgear, and more particularly to an open/close operating device of a gas insulated switchgear which performs an open/close operation of a moving part which is housed in a pressure vessel which is filled with an insulation gas.

2. Description of the Related Art

In an open/close operating device of a gas insulated switchgear in which a rotary shaft which is connected to a moving part and is housed in a pressure vessel filled with an insulation gas penetrates the pressure vessel, it is necessary to adjust a connecting member and the moving part which are mounted on the rotary shaft to an intended position that can assure the performance of the switchgear by correcting tolerances of parts and assembling.

To drive respective phases using a single operating device, by adjusting a length of a rod which connects the operating device and a lever of a rotary shaft at the time of converting an output of the operating device into a rotational force, it is possible to adjust an angle of the rotary shaft. However, parts which constitute the operating device become complicated.

On the other hand, when three phases are driven by one operating device, the mounting of a mechanism which adjusts axial angles of respective phases on a rotary portion is difficult from a viewpoint of working tolerance or easiness of assembly and it is necessary to connect between respective phases using a linearly movable rod whose length is adjustable and hence, there arises a drawback that constitutional parts become complicated and a movable mass is increased.

In the related art, with respect to such positional adjustment of the connecting member of the rotary shaft and the movable part, there has been proposed a technique in which there is provided a collar which includes a first spline hole portion which is eccentrically formed in an inner surface which allows the fitting of a first spline shaft portion of a rotary shaft and a second spline shaft portion which is formed in an outer surface which is fitted in a second spline hole portion of a lever which constitutes a connecting member, and the positional relationship is adjusted based on the fitting state of the first spline hole portion of the collar with respect to the first spline shaft portion of the rotary shaft (see, for example, JP-UM-A-4-66026).

Further, there has been also proposed a technique which adjusts the positional relationship by changing the circumferential position of an eccentric shaft by the insertion and the removal of a key (for example, JP-UM-A-55-85741).

However, in these related arts, the positional relationship is adjusted by directly changing over the connecting portions of the members by which a manipulating force is transmitted and hence, when a moving part is manipulated by allowing this type of manipulating mechanism to pass through a vessel which is filled with an insulating gas, it is necessary to release a sealed state of the vessel at the time of performing the changeover adjustment and, at the same time, there arises a possibility that a trouble occurs in the connecting operation attributed to the positional adjustment.

SUMMARY OF THE INVENTION

The invention has been provided to enable the acquisition of a gas insulated switchgear which can adjust the connection positional relationship between a moving part and a rotary shaft member which are housed in a vessel while properly supporting the rotary shaft member which penetrates the vessel filled with an insulation gas using bearing members and holding a sealed state without disassembling a gas sealing portion and the moving parts.

A gas insulated switchgear according to the invention includes: a rotary shaft member which penetrates a pressure vessel which is filled with an insulation gas, is connected with a moving part which is housed in the pressure vessel by way of a connecting member, and is interlockingly movable with the moving part; and bearing members which support the rotary shaft member and are mounted on a mounting portion formed on the pressure vessel, wherein the bearing members are fixed to the mounting portion at a predetermined angular position which uses a point offset from the center of rotation of the rotary shaft member as the center of rotation.

According to the invention, it is possible to acquire the gas insulated switchgear which can adjust the connection positional relationship between a moving parts and a rotary shaft member which are housed in a vessel while properly supporting the rotary shaft member which penetrates the vessel filled with an insulation gas using bearing members and holding a sealed state without disassembling a gas sealing portion and the moving parts.

DESCRIPTION OF THE PREFERRED EMBODIMENTS

Embodiment 1

Figure 1:
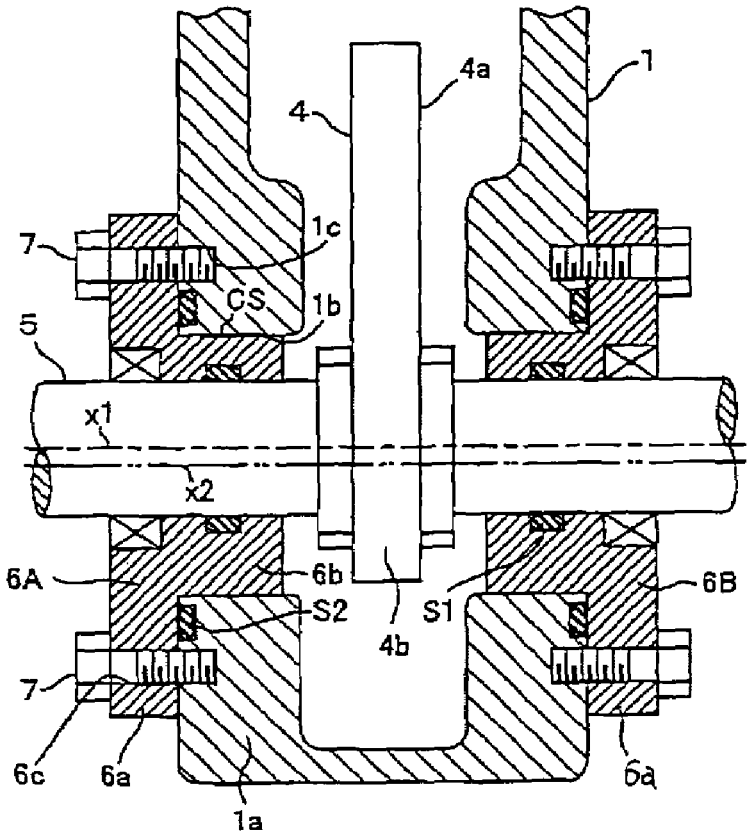
FIG. 1 is a longitudinal cross-sectional view showing the constitution of a gas insulated switchgear of an embodiment according to the invention.
Figure 2:
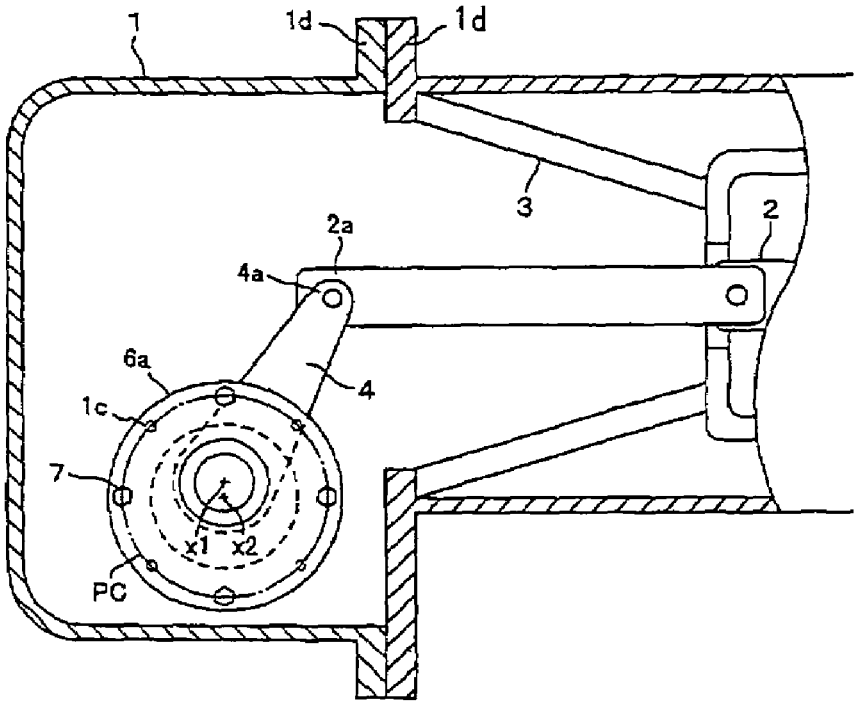
FIG. 2 is a side view showing the constitution of the gas insulated switchgear according to the embodiment of the invention.
Figure 3:
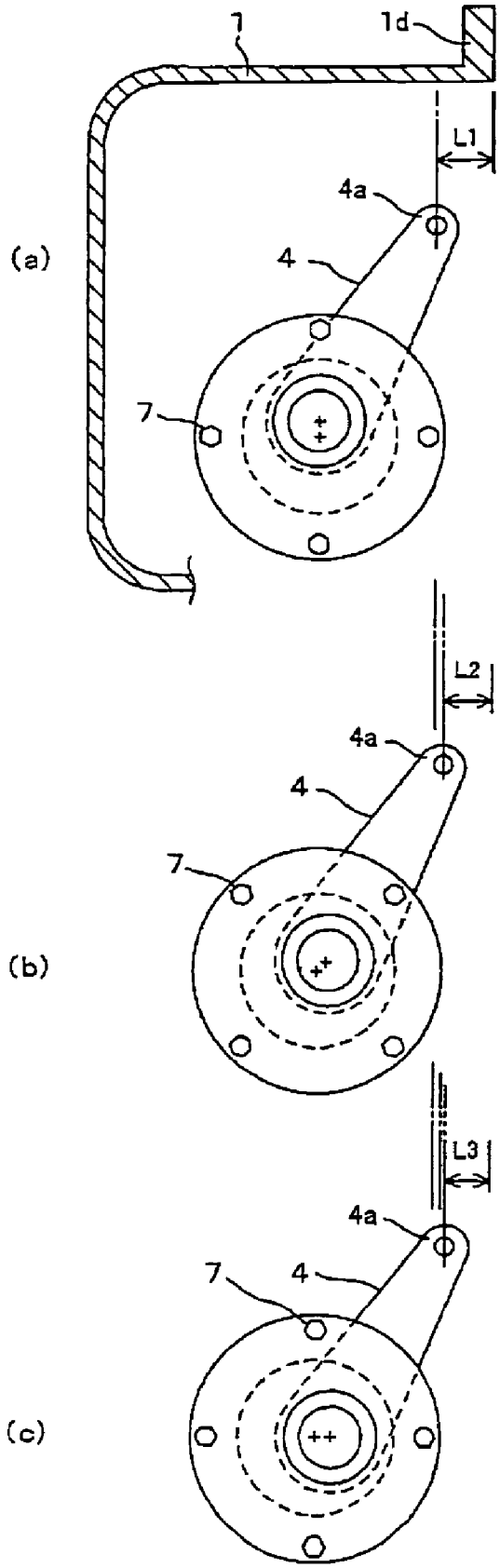
FIG. 3A to FIG. 3C are side views for explaining a size adjusting operation of the gas insulated switchgear of the embodiment according to the invention.

A gas insulated switchgear of the embodiment 1 according to the invention is explained in conjunction with FIG. 1 to FIG. 3C. FIG. 1 is a longitudinal cross-sectional view showing the constitution of the gas insulated switchgear of the embodiment according to the invention, FIG. 2 is a side view showing the constitution of the gas insulated switchgear according to the embodiment of the invention, FIG. 3A to FIG. 3C are side views for explaining a size adjusting operation of the gas insulated switchgear of the embodiment according to the invention.

In FIG. 1 and FIG. 2 which show the constitution of the gas insulated switchgear of the embodiment of the invention, an insulation gas such as $SF_6$ is filled in a pressure vessel 1. A moving part 2 which includes a movable contact portion which faces a fixed contact portion in an opposed manner is housed in the inside of the pressure vessel 2. and is supported on an insulation member 3 in an insulated manner.

The moving part 2 is connected to a lever 4 at a distal connection portion 4*a* thereof which moves in the peripheral direction due to the rotation of a lever 4, while a proximal portion 4*b* of the lever 4 which constitutes the center of rotation of the lever 4 is connected to a rotary shaft 5.

Both ends of the rotary shaft 5 penetrate the pressure vessel 1 which is filled with the insulation gas and are supported on a pair of brackets 6A, 6B. The brackets 6A, 6B have disc-shaped flange portions 6*a* thereof mounted on a mounting portion 1*a* of the pressure vessel 1 using fixing bolts 7. A sealing member S1 is provided between a peripheral surface of the rotary shaft 5 and the brackets 6A, 6B. Fitting portions 6*b* of the brackets 6A, 6B are fitted with the surface of the openings 1*b* which are formed in the mounting portion 1*a* of the pressure vessel 1.

In the mounting portion 1*a* of the pressure vessel 1, with respect to respective brackets 6A, 6B, eight threaded holes 1*c* which are arranged on an eccentric circle PC about an eccentric center axis x2 which is offset from a rotation center axis x1 of the rotary shaft 5 by a predetermined distance are formed at an equally spaced-apart manner from each other. In the flange portions 6*a* of the respective brackets 6A, 6B, four bolt insertion holes 6*c* are formed on the eccentric circle PC about the eccentric center axis x2 corresponding to eight threaded holes 1*c* formed in the mounting portion 1*a* of the pressure vessel 1. Fixing bolts 7 are inserted into these bolt insertion holes 6*c* and the fixing bolts 7 are threaded into four threaded holes 1*c* out of eight threaded holes 1*c* formed in the mounting portion 1*a* of the pressure vessel 1 whereby the brackets 6A, 6B are fastened to the mounting portion 1*a* of the pressure vessel 1. Sealing members S2 are provided between the flange portions 6*a* of the brackets 6A, 6B and the mounting portion 1*a* of the pressure vessel 1 and a sealing state is ensured by fastening the flange portions 6*a* of the brackets 6A, 6B to the mounting portion 1*a* of the pressure vessel 1.

Here, the fitting portions 6*b* of the brackets 6A, 6B which are fitted in the fitting holes 1*b* formed in the mounting portion 1*a* of the pressure vessel 1 have a disc-like shape having a circumferential surface about the eccentric center axis x2 which extends in the direction perpendicular to the extending direction of the flange portions 6*a* of the brackets 6A, 6B. Further, the fitting portions 6*b* of the brackets 6A, 6B are fitted in the circular fitting holes 1*b* formed in the mounting portion 1*a* of the pressure vessel 1 thus constituting a fitting structure portion CS. The fitting structure portion CS performs a function of reducing a size and the number of fixing bolts 7 by reducing a load applied in the direction perpendicular to axes of the fixing bolts 7.

The position adjusting operation, i.e. position adjustment process, of the gas insulated switchgear is explained in conjunction with FIG. 3

A state shown in FIG. 3(*a*) shows a positional relationship which is substantially equal to a positional relationship of the gas insulated switchgear shown in FIG. 2, wherein the distal end portion 4*a* of the lever 4 which is connected to the moving part 2 at the connecting portion 2*a* with the lever 4 assumes the leftmost position in the drawing (see FIG. 2) and is arranged at a position away from an abutting surface of a flange portions 1*d*,1*d* of the pressure vessel 1 toward the left side by a distance L1.

In moving and adjusting the position of the dial end portion 4*a* of the lever 4 which is connected to the connecting portion 2*a* of the moving part 2 with the lever 4 to the right side in the drawing, four fixing bolts 7 which fasten the flange portions 6*a* of the brackets 6A, 6B to the mounting portion 1*a* of the pressure vessel 1 are removed, and the flange portions 6*a* of the brackets 6A, SB are rotated in the clockwise direction in the drawing by 45° so to align the bolt insertion hole 6*c* which am formed in the flange portions 6*a* of the brackets 6A, 6B with the threaded holes 1*c* neighboring to the threaded holes 1*c* which am formed in the mounting portion 1*a* of the pressure vessel 1 and with which the fixing bolts 7 are already threadedly engaged, and four fixing bolts 7 are threadedly engaged with the neighboring threaded holes 1*c*. Due to such a constitution, with the use of these four fixing bolts 7 which penetrate the bolt insertion holes 6*c* which are formed in the flange portions 6*a* of tie brackets 6A, 6B, the flange portions 6*a* of the brackets 6A, 6B are again fastened to the mounting portion 1*a* of the pressure vessel 1 and hence, a state shown in FIG. 3(*b*) is established.

In the state shown in FIG. 3(*b*), the distal end portion 4*a* of the lever 4 which is connected to the connecting portion 2*a* of the moving part 2 with the lever 4 (see FIG. 2) is moved to a right side in the drawing and assumes a position which is on the side further to the right than Li in FIG. 3A and away from the abutting surface of a flange portion 1*d* of the pressure vessel 1 toward the left side by a distance L2. Accordingly, it is possible to perform the positional adjustment.

The positional adjustment hereinbefore permits to exchange the moving part 2 and/or the connecting portion 2*a* to another one without disassembling the pressure vessel 1 and the brackets 6A, 6B. The support state of the rotary shaft 5 and the brackets 6A, 6B is also maintained in the same manner and the operational state is ensured without obstructing the rotational operation of the rotary shaft 5.

In moving and adjusting the distal end portion 4*a* of the lever 4 which is connected to the connecting portion 2*a* of the moving part 4 with the lever 2 to the further left side in the drawing from the state shown in FIG. 3B, four fixing bolts 7 which fasten the flange portions 6*a* of the brackets 6A, 6B to the mounting portion 1*a* of the pressure vessel 1 are removed, and, the flange portions 6*a* of the brackets 6A, 6B are further rotated in the clockwise direction in the drawing by 45° so as to align the bolt insertion holes 6*c* which are formed in the flange portions 6*a* of the brackets 6A, 6B with the threaded holes 1*c* neighboring to the threaded holes 1*c* which are formed in the mounting portion 1*a* of the pressure vessel 1 and with which the fixing bolts 7 are already threadedly engaged, and four fixing bolts 7 are threadedly engaged with the neighboring threaded holes 1*c*. Due to such a constitution, with the use of these four fixing bolts 7 which penetrate the bolt insertion holes 6*c* which are formed in the flange portions 6*a* of the brackets 6A, 6B, the flange portions 6*a* of the brackets 6A, 6B are again fastened to the mounting portion 1*a* of the pressure vessel 1 and hence, a state shown in FIG. 3C is established.

In the state shown in FIG. 3(*c*), the distal end portion 4*a* of the lever 4 which is connected to the connecting portion 2*a* of the moving 2 with the lever 4 (see FIG. 2) is moved to a right side in the drawing and assumes a position which is on the side further right than L2 in FIG. 33 and away from the abutting surface of a flange portion 1*d* of the pressure vessel 1 toward the left side by a distance L3. Accordingly, it is possible to perform the positional adjustment.

Here, in shifting from the state shown in FIG. 3B to the state shown in FIG. 3C, the sealing action between the rotary shaft 5 and the fitting portions 6*b* of the brackets 6A, 6B and the sealing action between the mounting portion 1*a* of the pressure vessel 1 and the flange portions 6*a* of the brackets 6A, 6B are continuously performed by the shaft sealing members S1 and the sealing member S2 and hence, there is no possibility that the sealing state is broken. The support state of the rotary shaft 5 and the brackets 6A, 6B is also maintained in the same manner and the operational state is ensured without obstructing the rotational operation of the rotary shaft 5.

In this manner, the flange portions 6*a* of the brackets 6A, 6B can be fixed using the plurality of fixing bolts 7 which are arranged in a spaced-apart manner on the eccentric circle PC which has the center of rotation x2 thereof offset from the center of rotation x1 of the rotary shaft 5 and, the positional adjustment of the distal end portion 4*a* of the lever 4 can be performed by removing the fixing bolts 7 and by mounting the fixing bolt 7 again after rotating the flange portions 6*a* of the brackets 6A, 6B.

Here, in the embodiment shown in FIG. 1 to FIG. 3, the explanation has been made with respect to a case in which eight threaded holes 1*c* are formed in the mounting portion 1*a* of the pressure vessel 1, eight bolt insertion holes 6*c* are formed in the flange portions 6*a* of the brackets 6A, 6B, and the flange portions 6*a* of the brackets 6A, 6B are fastened to the mounting portion 1*a* of the pressure vessel 1 using four fixing bolts 7 which penetrate the bolt insertion holes 6*c* and are threadedly engaged with the threaded holes 1*c*. However, in an actual operation, sixteen threaded holes 1*c* are formed in the mounting portion 1*a* of the pressure vessel 1, four bolt insertion holes 6*c* are formed in each of the flange portions 6*a*, 6*a* of the brackets 6A, 6B, and the flange portions 6*a* of the brackets 6A, 6B are fastened to the mounting portion 1*a* of the pressure vessel 1 using, for example, eight fixing bolts 7 which penetrate the bolt insertion holes 6*c* corresponding to some of these threaded holes 1*c* at an equal interval.

Due to such actual constitution, the flange portions 6*a* of the brackets 6A, 6B can be rotatably adjusted for every 22.5° and hence, the fine adjustment of the positional relationship of the distal end portion 4*a* of the lever 4 can be achieved.

According to the embodiment of the invention, in the switchgear having the structure which transmits a driving force generated by the manipulating device in air to the moving part in gas by way of the rotary shaft seal, the bolts 7 for fixing the brackets 6A, 6B which hold the rotary shaft 5 to the pressure vessel are arranged on the circumference about the rotary shaft 5 while being offset from the rotary shaft 5.

By rotating the above-mentioned brackets 6A, 6B about the center of a pitch circle PC of fixing bolts as an axis, it is possible to move the center x1 and the position of the lever 4 which is rotated about the rotary shaft 5 due to the offset of the center axis x2 and hence, it is possible to correct the tolerances of parts and assembly without disassembling the gas sealed portion and the moving part thus adjusting the position of the moving part in gas.

According to the embodiment of the invention, the gas insulated switchgear includes the rotary shaft member formed of the rotary shaft 5 which penetrates the pressure vessel 1 which is filled with an insulation gas, is connected with the moving part 2 including the movable contact element which is housed in the pressure vessel 1 by way of the connecting member formed of the lever 4, and is interlockingly movable with the moving 2; and bearing members formed of the brackets 6A, 6B which support the rotary shaft member formed of the rotary shaft 5 and are mounted on the mounting portion 1*a* formed on the pressure vessel 1, wherein the bearing members formed of the brackets 6A, 6B are fixed to the mounting portion 1*a* formed on the pressure vessel 1 using the plurality of fixing bolts 7 which are arranged in a spaced-apart manner on the eccentric circle PC having the center at the point x2 offset from the rotary center x1 of the rotary shaft member formed of the rotary shaft 5 and hence, the bearing members formed of the brackets 6A, 6B can be fixed to the mounting portion 1*a* formed on the pressure vessel 1 at a predetermined angular position which uses the point x2 offset from the center of rotation x1 of the rotary shaft member formed of the rotary shaft 5 as the center of rotation. Accordingly, by mounting or dismounting the fixing bolts, it is possible to acquire the gas insulated switchgear which can adjust the connection positional relationship between the moving part and the rotary shaft member which are housed in the pressure vessel while holding a state in which the bearing member properly supports the rotary shaft member which penetrates the pressure vessel without disassembling the gas sealing portion arid the moving part.

Further, according to this embodiment of the invention, in the above mentioned constitution, the filling structure CS which has the circumference thereof having the same center as the eccentric circle PC is arranged between the bearing members which are formed of the brackets 6A, 6B and the bearing members support portions which are formed of the filling holes 1*b* in which the fitting portions 6*b* of the bearing members formed of the brackets 6A, 6B are fitted, wherein the fitting holes 1*b* are formed in the mounting portion 1*a* which, in turn, is formed on the pressure vessel 1 to support the bearing members which are formed of the brackets 6A, 6B. Accordingly, by mounting or dismounting the fixing bolts, it is possible to acquire the gas insulated switchgear which can adjust the connecting positional relationship between the moving part and the rotary shaft member which are housed in the pressure vessel while holding a state in which the bearing member properly supports the rotary shaft member which penetrates the pressure vessel without disassembling the gas sealing portion and the moving part. Further, by reducing the stresses which are applied to the fixing bolts in the fastening direction and in the direction perpendicular to the fastening direction, it is possible to reduce the size and the number of fixing bolts.

What is claimed is:

1. A gas insulated switchgear comprising:

a rotary shaft member penetrates a vessel which is filled with an insulation gas, is connected with a moving part which is housed in the vessel by way of a connecting member, and is interlockingly movable with the moving part; and bearing members support the rotary shaft member and are mounted on a mounting portion formed on the vessel, wherein the mounting portion having a plurality of points arranged on an eccentric circle which is offset from a center of rotation of the rotary shaft member, and the bearing members are fixed to the plurality of points on the mounting portion at predetermined angular positions.

2. A gas insulated switchgear comprising:

a rotary shaft member penetrates a vessel which is filled with an insulation gas, is connected with a moving part which is housed in the vessel by way of a connecting member, and is interlockingly movable with the moving part; and bearing members support the rotary shaft member and are mounted on a mounting portion formed on the vessel, wherein the mounting portion having a plurality of holes arranged on an eccentric circle which is offset from a center of rotation of the rotary shaft member, and the bearing members are fixed to the plurality of holes of the mounting portion using a plurality of bolts which are arranged in a spaced apart manner.

3. The gas insulated switchgear according to claim 2, wherein a fitting structure, having a circumference surrounding the same center of rotation as the eccentric circle, is arranged between the bearing members and bearing members support portions of the vessel which support the bearing members.

* * * * *